US006846451B2

(12) United States Patent
Uchida et al.

(10) Patent No.: US 6,846,451 B2
(45) Date of Patent: Jan. 25, 2005

(54) MAGNESIUM ALLOY AND MAGNESIUM ALLOY MEMBER SUPERIOR IN CORROSION RESISTANCE

(75) Inventors: Ryouhei Uchida, Hiroshima (JP); Kenzi Yamada, Hiroshima (JP); Makoto Matsuyama, Hiroshima (JP); Tadayoshi Tsukeda, Hiroshima (JP)

(73) Assignee: The Japan Steel Works, Ltd., Tokyo (JP)

( * ) Notice: Subject to any disclaimer, the term of this patent is extended or adjusted under 35 U.S.C. 154(b) by 90 days.

(21) Appl. No.: 10/122,725

(22) Filed: Apr. 16, 2002

(65) Prior Publication Data

US 2003/0039575 A1 Feb. 27, 2003

(30) Foreign Application Priority Data

Aug. 23, 2001 (JP) ..... P2001-252764

(51) Int. Cl.[7] ..... C22C 23/02

(52) U.S. Cl. ..... 420/407; 420/408; 420/409; 420/410

(58) Field of Search ..... 420/407, 408, 420/409, 410

(56) References Cited

U.S. PATENT DOCUMENTS 4,997,622 A * 3/1991 Regazzoni et al. ..... 420/407
5,073,207 A * 12/1991 Faure et al. ..... 148/2
5,147,603 A * 9/1992 Nussbaum et al. ..... 420/409
5,223,215 A * 6/1993 Charbonnier et al. ..... 420/407
5,681,403 A * 10/1997 Makino et al. ..... 148/420
5,811,058 A 9/1998 Baba et al.
5,855,697 A * 1/1999 Luo et al. ..... 148/420
6,264,763 B1 7/2001 Powell et al.
6,322,644 B1 * 11/2001 Pekguleryuz et al. ..... 148/420

FOREIGN PATENT DOCUMENTS

| | | |
|---|---|---|
| EP | 0 419 375 B1 | 3/1991 |
| EP | 0 478 479 B1 | 4/1992 |
| EP | 0 799 901 A1 | 10/1997 |
| JP | 6-25790 | 2/1994 |

OTHER PUBLICATIONS

Mctall, 44, 8. pp. 748–753, Aug. 1990.
Metall, 46, 6, pp. 570–574, Jun. 1992.

* cited by examiner

*Primary Examiner*—Daniel Jenkins
(74) *Attorney, Agent, or Firm*—Sughrue Mion, PLLC

(57) ABSTRACT

There is provided a magnesium alloy containing mass percent Al: 5% to 7%, Ca: 2% to 4%, Mn: 0.1% to 0.8%, Sr: 0.001% to 0.05% and rare earth elements: 0.1% to 0.6%. If necessary, an allowable content is set in each of Si, Zn, Cu, Ni, Fe and Cl of the unavoidable impurities, with Si not higher than mass percent 0.01%, Zn not higher than mass percent 0.01%, Cu not higher than mass percent 0.008%, Ni not higher than mass percent 0.001%, Fe not higher than mass percent 0.004%, and Cl not higher than mass percent 0.003%. There is also provided a magnesium alloy member injected in the die by using such an alloy.

2 Claims, 10 Drawing Sheets

INFLUENCE OF Sr CONTENT ON CORROSION RATE AND MINIMUM CREEP RATE (ACaSr63x)

● : CORROSION RATE
■ : MINIMUM CREEP RATE

INFLUENCE OF Ca CONTENT ON CORROSION RATE AND MINIMUM CREEP RATE (ACa6x)

● : CORROSION RATE
■ : MINIMUM CREEP RATE

INFLUENCE OF Al CONTENT ON CORROSION RATE AND MINIMUM CREEP RATE (ACax3)

● : CORROSION RATE
■ : MINIMUM CREEP RATE

INFLUENCE OF Sr CONTENT ON CORROSION RATE AND MINIMUM CREEP RATE (ACaSr63x)

● : CORROSION RATE
■ : MINIMUM CREEP RATE

INFLUENCE OF Mm CONTENT ON CORROSION RATE AND MINIMUM CREEP RATE (ACaE63x)

● : CORROSION RATE
■ : MINIMUM CREEP RATE

INFLUENCE OF Al CONTENT ON CORROSION RATE AND MINIMUM CREEP RATE (ACaESrx30550p)

● : CORROSION RATE
■ : MINIMUM CREEP RATE

INFLUENCE OF Ca CONTENT ON CORROSION RATE AND MINIMUM CREEP RATE (ACaESr6x0550p)

● : CORROSION RATE
■ : MINIMUM CREEP RATE

INFLUENCE OF Sr CONTENT ON CORROSION RATE AND MINIMUM CREEP RATE (ACaESr6305x)

● : CORROSION RATE
■ : MINIMUM CREEP RATE

HIGH TEMPERATURE TENSILE PROPERTIES

ROTATIONSHIP BETWEEN AVERAGE INJECTION SPEED AND FILLING RATE

ROTATIONSHIP BETWEEN AVERAGE INJECTION SPEED AND FILLING RATE

MAGNESIUM ALLOY AND MAGNESIUM ALLOY MEMBER SUPERIOR IN CORROSION RESISTANCE

BACKGROUND OF THE INVENTION

1. Field of the Invention

The present invention relates to magnesium alloys which has superior corrosion resistance and is superior in both heat resistance and casting properties, and magnesium alloy members produced using such magnesium alloys by various high-pressure casting methods such as metal injection molding, die-casting, and squeeze casting.

2. Related Art

Magnesium alloys are light in weight and superior not only in strength at room temperature but also in strength at high temperature. Thus, magnesium alloys are expected to apply to various applications. For example, heat-resistant members superior in corrosion resistance, such as transmission cases or oil pans, have been expected to put into practical use in the field of automobile. Such heat-resistant members can be formed from magnesium alloys so as to make a automobile body light in weight. As a result, the improvement of fuel consumption can be expected to contribute to suppression of global warming. In addition, in the field of household appliances, corrosion resistance and heat resistance are requirements for housings of liquid crystal projectors having light sources inside. Such housings can be formed from magnesium alloys. Thus, magnesium alloys can contribute to expansion of high-strength portable appliances. In other fields, magnesium alloys are expected to apply to light-weight members having corrosion resistance and heat resistance as requirements, such as machine tools or leisure goods.

As magnesium alloys of this type, in the conventional art, there were Al—Si-based alloys called AS41 and AS21, and Al—Mm-based alloys called AE42. Further, various alloys were proposed as follows, though they are not yet put into practical use.

Incidentally, contents of the following alloys are represented as "mass percent" by unit.

(1) An Mg alloy containing 1% to 6% of Al, 0.5% to 4% of Ca, 0.5% to 1.5% of Si, 0.15% to 0.5% of Mn and 0.1% to 0.3% of Zn (Japanese Patent Publication No. 17890/1991).

(2) An Mg alloy containing 2% to 10% of Al, 1.4% to 10% of Ca, 2% or less of Si, 2% or less of Zn and 4% or less of rare earth elements, providing Ca/Al≧0.7 (Japanese Patent Laid-Open No. 25790/1994).

(3) An Mg alloy containing 5% to 10% of Al, 0.2% to 1.0% of Si, 0.05% to 0.5% of Ca, and Sr ≦0.1% (Japanese Patent Publication No. 104942/1997).

(4) An Mg alloy containing 2% to 10% of Al, 1.0% to 10% of Ca, at least one of Si, Mn, Zn, Zr being ≦2%, and rare earth elements ≦4% (Japanese Patent Laid-Open No. 271919/1997).

(5) An Mg alloy containing 2% to 6% of Al, 0.5% to 4% of Ca, providing Ca/Al ≦0.8, and Sr ≦0.15% (Japanese Patent Publication No. 272945/1997).

Next, description will be made about operations of additional elements in the respective conventional alloys (including the proposed conventional alloys).

Al forms a hard intermetallic compound ($Mg_{17}Al_{12}$) together with Mg. Thus, its strengthened dispersion enhances the yield strength and the tensile strength of the alloy. Ca forms a high-melting-point intermetallic compound together with Al or Mg so as to enhance the tensile strength and the creep resistance. Si forms a high-melting-point intermetallic compound ($Mg_2Si$) together with Mg so as to enhance the tensile strength and the creep resistance. Zn improves the aging ability. Rare earth elements (chiefly mesh metal: Mm) form an intermetallic compound together with Al so as to improve the creep resistance and the corrosion resistance as well as the elongation at high temperature.

Description will be made about problems of the additional elements in the conventional alloys.

Al is an element for improving the strength. However, excessive addition of Al result in increase of $Mg_{17}Al_{12}$ which is a low-melting-point and brittle intermetallic compound. Thus, the tenacity is reduced while the creep resistance is reduced.

Ca or Si has an effect to improve the tensile strength and the creep resistance a elevated temperatures . However, excessive addition of Ca result in not only decrease of the tenacity but also increase of the crack sensitivity during casting. Further, as the content of Ca increase, the corrosion resistance deteriorates suddenly.

Si forms a compound together with Ca so easily that considerable compound is crystallized during melting. Thus, the yield ratio of molten metal is reduced.

Zn is also an element for improving the strength. However, Zn lowers the creep resistance and increases the crack sensitivity during casting.

The rare earth elements are effective in improving the creep properties. However, the rare earth elements increase the material cost. In addition, the rare earth elements are oxidized so easily as to stick to a die. Moreover, conventional alloys were generally so high in melting point that the melting temperature had to be increased. Thus, molten metal burned easily. In addition, the solidus temperature was also so high that the fluidity of molten metal deteriorates. Thus, a casting failure was easily produced. Therefore, parts made of such alloys have not come to function for practical use.

Of such alloys, an Mg—Al—Ca alloy expected as a low-cost heat-resistant alloy containing no rare earth elements had a significant defect that addition of 2 mass % or higher of Ca required for obtaining satisfactory creep properties results in marked deterioration of the corrosion resistance.

SUMMARY OF INVENTION

The invention was developed to solve the problems of the conventional alloys. It is an object of the invention to provide a magnesium alloy in which alloy design is made particularly in consideration of corrosion resistance that has been hardly considered in the conventional alloys, so that good casting properties are secured even in low melting temperature while the magnesium alloy has superior corrosion resistance and excellent heat resistance; and a magnesium alloy member produced using the magnesium alloy.

In the invention, paying attention to Al, Ca, Mn, Sr and rare earth elements as additional elements, ingots changed in composition of the respective elements were produced. Further, raw material chips for a metal injection molding method which was one of high-pressure casting methods were formed from the ingots, and then specimens were produced. The components were optimized on the basis of salt spray tests, creep tests, tensile tests at elevated temperatures, and formability tests up to 100 hours. Thus, magnesium alloys which can deal with both corrosion resistance and heat resistance were found out.

According to a first aspect of the present invention, in order to solve the problem, according to the invention, there is provided a magnesium alloy superior in corrosion resistance and heat resistance, containing 5% to 7% by mass of Al, 2% to 4% by mass of Ca, 0.1% to 0.8% by mass of Mn, 0.001% to 0.05% by mass of Sr and 0.1% to 0.6% by mass of rare earth elements, a remainder of the magnesium alloy being composed of Mg and unavoidable impurities.

According to a second aspect of the present invention, as in the first aspect of the present invention, an allowable content is set in each of Si, Zn, Cu, Ni, Fe and Cl of the unavoidable impurities, with Si not higher than 0.01% by mass, Zn not higher than 0.01% by mass, Cu not higher than 0.008% by mass, Ni not higher than 0.001% by mass, Fe not higher than 0.004% by mass, and Cl not higher than 0.003% by mass.

According to a third aspect of the present invention, in the first or second aspect of the present invention, there is provided a magnesium alloy member superior in corrosion resistance and heat resistance, the alloy molten produced by a high pressure casting process of injecting the alloy under a semi solid condition being 50% or less in solid phase rate into a die.

DETAILED DESCRIPTION OF PREFERRED EMBODIMENTS

Figure 1:
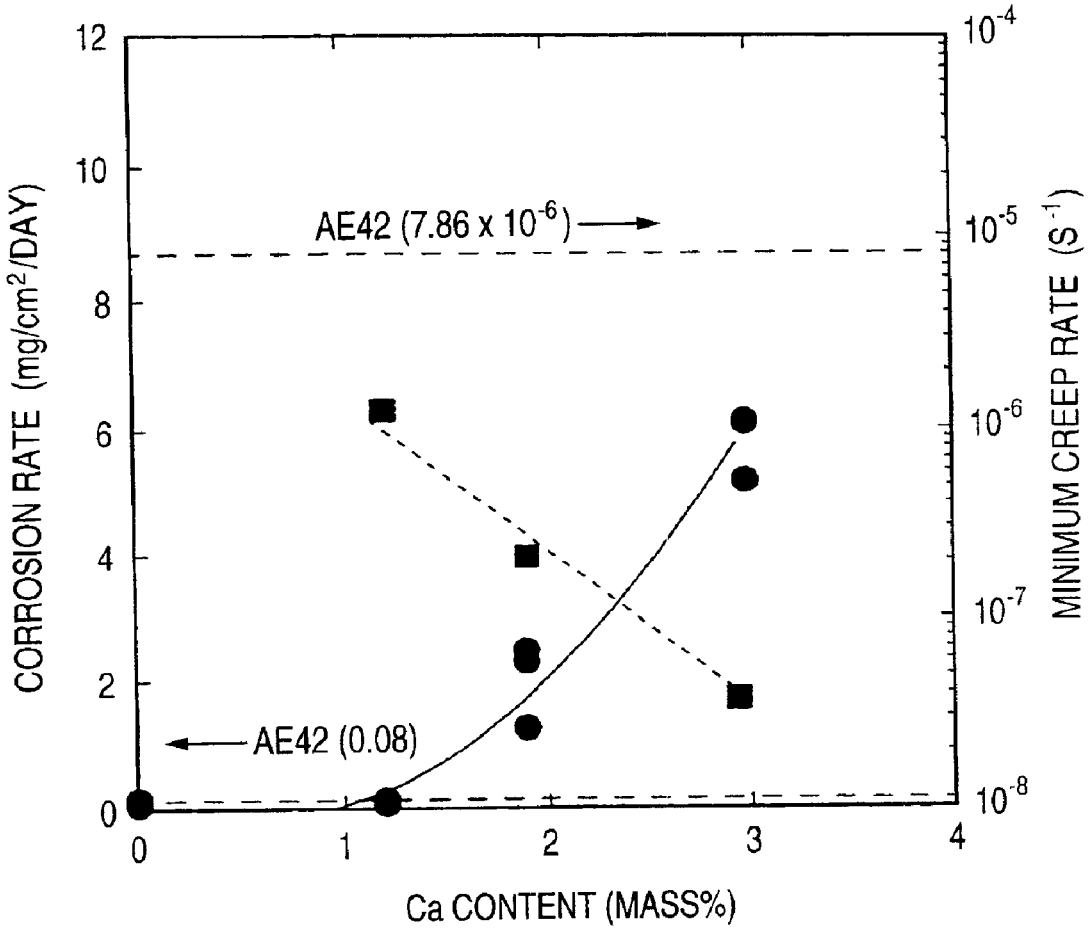
FIG. 1 is a graph showing the influence of the Ca content on the corrosion rate and the minimum creep rate.

Primary, description will be made about the operations of the additional elements in the invention.

Al: Mass Percent 5% to 7%

Al hardly dissolves as a solid solution in an Mg matrix phase, but is condensed in front of concretions of primary Mg crystals. As a result, good fluidity can be obtained till Al forms eutectics with Mg or Ca. At this time, Al has a high melting point if it is lower than 5% by mass. Accordingly, the melting temperature in manufacturing or casting process of alloy ingot has to be increased so that workability deteriorates. On the other hand, if Al exceeds 7% by mass, intermetallic compounds increase so that the crack sensitivity during casting increases, and the corrosion resistance deteriorates. Therefore, the content of Al is limited to such a range. Incidentally, it is more preferable that the lower limit of the content of Al is set as 5.2% and the upper limit thereof is set as 6.8%.

Ca: Mass Percent 2% to 4%

Ca forms intermetallic compounds with Mg and Al, crystallized in network formation chiefly at crystalline interfaces. The intermetallic compounds operate as obstacles to upstrokes for dislocation so that the resistance to creep deformation is enhanced. At this time, if the addition of Ca are lower than 2% by mass, the effect is not sufficient. If the addition exceed 4% by mass, cracks are easily produced during casting. Accordingly, the content of Ca is limited to such a range. Incidentally, it is more preferable that the lower limit of Ca is set as 2.2% and the upper limit thereof is set as 3.8%.

Mn: Mass Percent 0.1% to 0.8%

Mn forms an intermetallic compound with Al. Accordingly, Fe which is an impurity element is dissolved as a solid solution. Thus, the deterioration of corrosion resistance is restrained. At this time, if the content of Mn is lower than 0.1% by mass, the effect is not sufficient. If the content of Mn exceeds 0.8% by mass, the yield ratio of melting deteriorates. Accordingly, the content of Mn is limited to such a range. Incidentally, it is more preferable that the lower limit of Mn is set as 0.2% and the upper limit thereof is set as 0.6%.

Rare Earth Elements: Mass Percent 0.1% to 0.6%

Rare earth elements form intermetallic compounds with Al, improving the corrosion resistance dramatically. At this time, if the content of rare earth elements is lower than 0.1% by mass, sufficient corrosion resistance cannot be obtained. If the content of rare earth elements exceeds 2.0% by mass, the yield ratio of melting deteriorates. In addition, the creep resistance is improved on a large scale if 0.1% by mass of rare earth elements is added. However, if 1% or more by mass of rare earth elements are added, the properties deteriorate. Further, if the content of rare earth elements exceeds 0.5% by mass, the fluidity deteriorates due to the increase of the content of rare earth elements. However, if Sr which will be described later is added, deterioration in formability caused by the addition of rare earth elements is improved. Thus, if the content of rare earth elements is not higher than 0.6% by mass, good formability is secured. Incidentally, as such rare earth elements, one member selected from the group of rare earth elements may be added, or two or more members selected from the group of rare earth elements may be added. Further, rare earth elements may be added in the form of mish metal.

Sr: 0.001% to 0.05% Mass Percent

Sr added slightly is dissolved as a solid solution in crystallized materials at crystalline interfaces. The Sr solid solution has an effect to improve the corrosion resistance while keeping creep properties superior. In addition, it was found out that added Sr could recover the deteriorated fluidity caused by the addition of rare earth elements exceeding 0.5% by mass. At this time, if Sr is lower than 0.001% by mass, the recovery of the deteriorated corrosion resistance and fluidity is not sufficient. If Sr exceeds 0.05% by mass, the yield ratio of melting Sr into molten metal deteriorates.

Si: not higher than mass percent 0.01%
Zn: not higher than mass percent 0.01%
Cu: not higher than mass percent 0.008%
Ni: not higher than mass percent 0.001%
Fe: not higher than mass percent 0.004%
Cl: not higher than mass percent 0.003%

Impurity elements of Si, Zn, Cu, Ni, Fe and Cl deteriorate the corrosion resistance. It is therefore very important to control the allowable values of these impurity elements. In order to prevent the corrosion resistance from being deteriorated, all of the elements have to satisfy the conditions.

A magnesium alloy according to the invention is produced in a melt with such component ranges as aimed values. The production method in the invention is not limited especially, but any method generally used may be adopted. A magnesium alloy produced in a melt can be applied to a casting process which is a post-process, as it is or after it is once formed into a slab.

As the casting method in the casting process, various methods generally known can be adopted. However, the magnesium alloy according to the invention has superior casting properties, and hence it is a material suitable for high-pressure casting methods such as die-casting, squeeze casting and metal injection molding, by which a high quality material can be obtained though high casting properties are required.

The conditions in these casting methods are not limited especially in the invention, but it is preferable that the solid phase ratio of molten metal is set to be not higher than 50% in partially melting molding. This is because there is a fear that good molding becomes difficult due to deteriorated fluidity of molten metal even in an alloy with good casting properties according to the invention if the solid phase ratio exceeds 50%.

In the high-pressure casting methods, a molten alloy (including the case of semi solid condition) has high fluidity. Thus, when the molten alloy is molded into a thin product, the molten alloy can be cast with a good melt flow so that the product can be obtained with a high yield. In addition, a member obtained thus has little defect due to the good melt flow. Thus, superior properties can be secured even in a high-strength material.

Accordingly, products molded of an alloy according to the invention can be used as members light in weight, high in strength and superior in high-temperature properties and corrosion resistance in various applications. Thus, the use of such products in automobile parts or various portable apparatus needing such characteristics can be expected to expand. Further, the applications of such products to machine tools or leisure goods can be also expected to expand. In addition, such magnesium alloy products can be recycled more easily than conventional plastic products, so as to contribute to the conservation of global environment.

EXAMPLES

Examples of the invention will be described below with reference to the drawings.

Alloy ingots according to the invention and alloy ingots according to the conventional for comparison were molten and produced, and then cut to produce various raw material chips. Table 1 shows the chemical analysis results of the raw material chips.

Casting was carried out in a metal injection molding method (die clamping force of 450 t) which was one of high-pressure casting methods. Thus, tensile/creep test specimens each having a parallel-portion diameter of 6 mm, flat plates (specimens for salt spray tests) each having a thickness of 2 mm, and flat plates (specimens for formability estimation) each having a thickness of 1 mm were produced. In order to measure only compositions, the molding conditions were constant in barrel temperature (903K), die temperature (443K) and injection speed (1.7 m/s), and it was confirmed with a optical microscope that the solid phase ratio was 0%. Only in the case of formability estimation, the injection speed was varied in a range of from 0.5 m/s to 1.9 m/s. Heat resistance was estimated by creep tests at 473K and 90 MPa and tensile tests at elevated temperatures from room temperature to 473K. Corrosion resistance was estimated by salt spray tests for 100 h. Formability was estimated by fillability of the flat plates 1 mm thick.

TABLE 1

| Class | Alloy | Al | Mn | Ca | Sr | Mm | mass % Mg |
|---|---|---|---|---|---|---|---|
| Comp. 1 | ACa61 | 5.88 | 0.24 | 1.20 | — | — | Bal. |
| Comp. 2 | ACa62 | 5.84 | 0.32 | 1.88 | — | — | Bal. |
| Comp. 3 | ACa63 | 5.57 | 0.32 | 3.25 | — | — | Bal. |
| Comp. 4 | ACa43 | 3.99 | 0.26 | 3.04 | — | — | Bal. |
| Comp. 5 | ACa53 | 4.87 | 0.24 | 3.02 | — | — | Bal. |
| Comp. 6 | ACa73 | 6.76 | 0.20 | 3.02 | — | — | Bal. |
| Comp. 7 | ACa83 | 7.78 | 0.21 | 3.05 | — | — | Bal. |
| Comp. 8 | ACaSr6310p | 6.00 | 0.27 | 2.94 | 0.0043 | — | Bal. |
| Comp. 9 | ACaSr6350p | 6.06 | 0.23 | 2.76 | 0.0060 | — | Bal. |
| Comp. 10 | ACaSr63100p | 6.27 | 0.30 | 2.95 | 0.0143 | — | Bal. |
| Comp. 11 | ACaSr63300p | 6.02 | 0.25 | 2.97 | 0.0370 | — | Bal. |
| Comp. 12 | ACaE6301 | 6.16 | 0.44 | 3.30 | — | 0.14 | Bal. |
| Comp. 13 | ACaE6305 | 6.04 | 0.34 | 3.15 | — | 0.51 | Bal. |
| Comp. 14 | ACaE631 | 6.22 | 0.34 | 3.03 | — | 1.14 | Bal. |
| Comp. 15 | ACaE632 | 6.22 | 0.26 | 3.17 | — | 1.93 | Bal. |
| Ex. 1 | ACaESr530550p | 5.75 | 0.34 | 3.28 | 0.0072 | 0.57 | Bal. |
| Ex. 2 | ACaESr630550p | 6.16 | 0.32 | 3.20 | 0.0060 | 0.53 | Bal. |
| Comp. 16 | ACaESr730550p | 7.86 | 0.28 | 3.27 | 0.0069 | 0.54 | Bal. |
| Comp. 17 | ACaESr830550p | 8.63 | 0.26 | 3.22 | 0.0066 | 0.51 | Bal. |
| Comp. 18 | ACaESr61.50550p | 6.08 | 0.33 | 1.48 | 0.0058 | 0.50 | Bal. |
| Ex. 3 | ACaESr620550p | 5.98 | 0.33 | 2.03 | 0.0062 | 0.53 | Bal. |
| Ex. 4 | ACaESr62.50550p | 5.90 | 0.33 | 2.51 | 0.0063 | 0.53 | Bal. |
| Ex. 5 | ACaESr6305100p | 6.23 | 0.33 | 3.20 | 0.0120 | 0.53 | Bal. |
| Ex. 6 | ACaESr6305300p | 5.91 | 0.32 | 3.20 | 0.0340 | 0.52 | Bal. |
| Comp. 19 | AE42 | 4.30 | 0.28 | — | — | 2.91 | Bal. |

FIG. 1 shows the relationship between the Ca content and the corrosion rate calculated from weight loss between before and after salt spray tests for 100 h and the relationship between the Ca content and the minimum creep rate calculated from creep tests in the Al and Ca containing Mg alloys. In order to obtain superior corrosion resistance and creep resistance, it is necessary to add 2% or more by mass of Ca.

However, if the Ca content exceeds 2% by mass, the corrosion resistance deteriorates suddenly.

Figure 2:
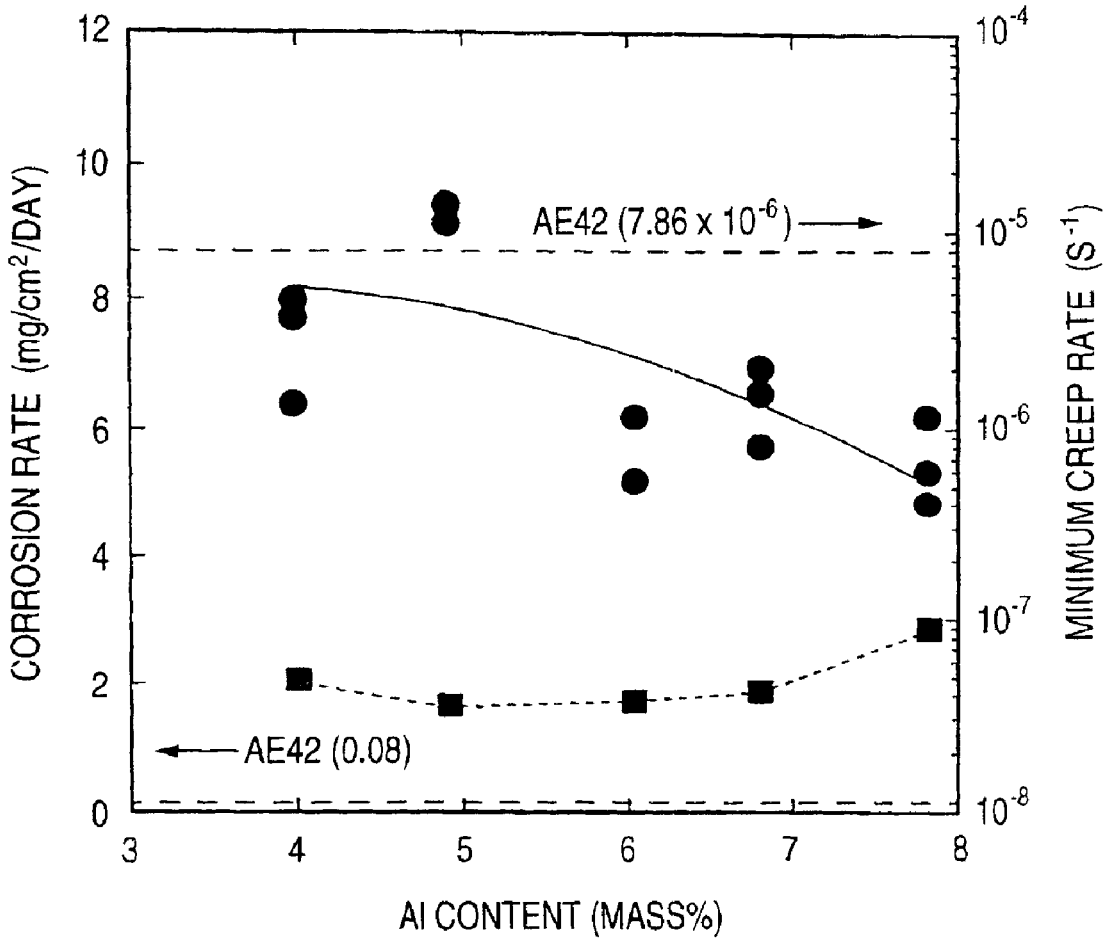
FIG. 2 is a graph showing the influence of the Al content on the corrosion rate and the minimum creep rate.

It has been known that the corrosion resistance of Mg—Al-based alloys not containing Ca is improved with the increase of the Al content. FIG. 2 shows the influence of the Al content on the corrosion rate and the minimum creep rate in the Al and Ca containing Mg alloys. The Al and Ca containing Mg alloys have no difference in the creep properties and the corrosion resistance in accordance with the variation of the Al content. That is, the improvement of the corrosion resistance cannot be expected by the increase of the Al content in the Ca containing alloys.

Figure 3:
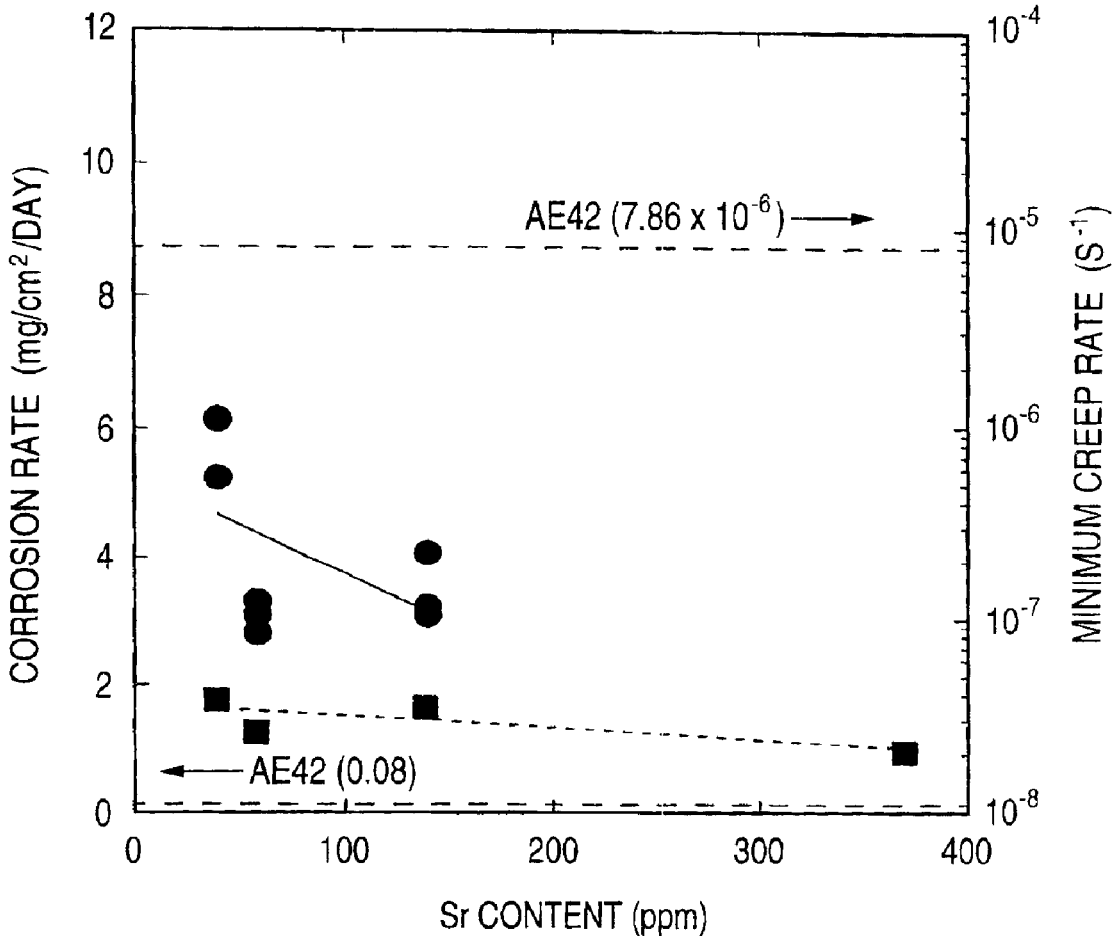
FIG. 3 is a graph showing the influence of the Sr content on the corrosion rate and the minimum creep rate.

FIG. 3 shows the influence of the Sr content on the corrosion rate and the minimum creep rate. Although the improvement of the corrosion resistance is improved by adding Sr to the Al and Ca containing Mg alloys, the corrosion rate and the minimum creep rate deteriorate on a large scale compared with those of AE42 which is an alloy in the conventional usage.

Figure 4:
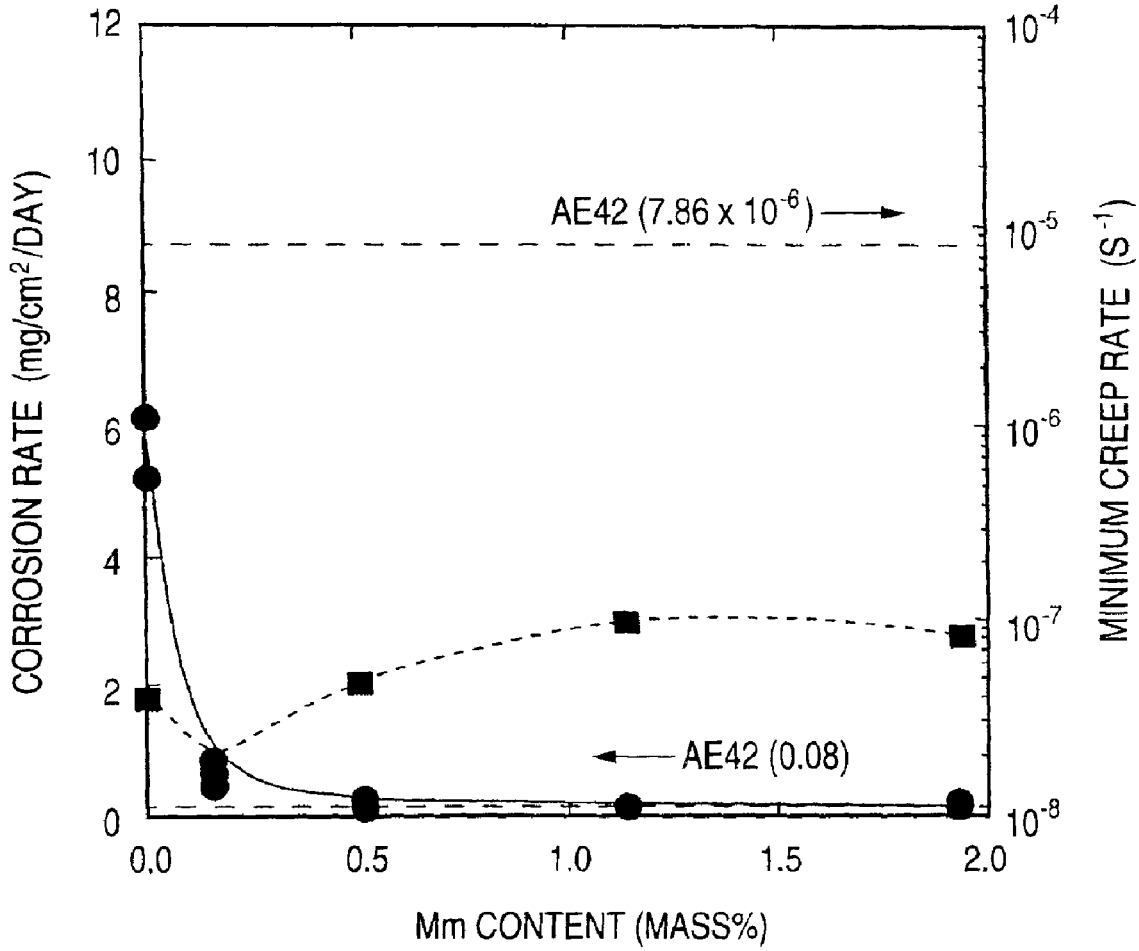
FIG. 4 is a graph showing the influence of the Mm content on the corrosion rate and the minimum creep rate.

FIG. 4 shows the influence of the Mm content on the corrosion rate and the minimum creep rate. It has been proved that the corrosion resistance is improved on a large scale by adding Mm to the Al and Ca containing Mg alloys. The improvement of the corrosion resistance is recognized in the Mm content of 0.5% or lower by mass but little changes in the Mm content higher than 0.5% by mass. The creep properties are improved by adding 0.1% by mass of Mm, but have a tendency to deteriorate by adding Mm exceeding 1% by mass. That is, the improvement of the corrosion resistance was found by the addition of Mm, but further improvement would be required for practical use. The corrosion rate of AZ91D, AM60B and AE42 which are alloys in the conventional usage are 0.02, 0.06 and 0.08 $m/cm^2$/day respectively. For practical use, investigation was made to have the aimed value at 0.1 $mg/cm^2$/day or lower.

Figure 5:
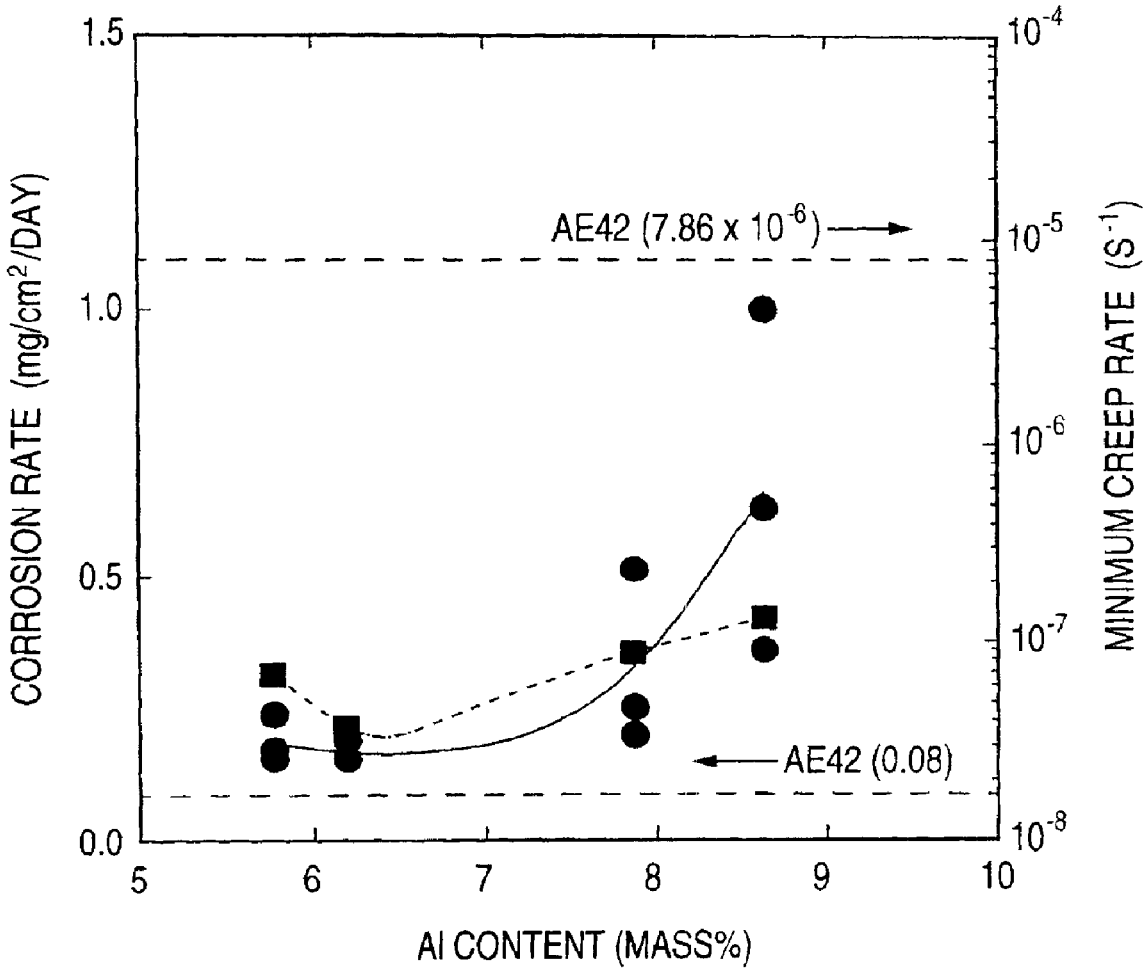
FIG. 5 is a graph showing the influence of the Al content on the corrosion rate and the minimum creep rate.

A very small amount of Sr was added to the Al, Ca and Mm containing alloys so as to attain the aimed value. FIG. 5 shows the influence of the Al content on the corrosion rate and the minimum creep rate in the alloys. In contrast to Mg—Al-based alloys not containing Ca, the Mm containing alloys to which a very small amount of Sr was added showed superior corrosion resistance in the Al content not higher than 7% by mass. When the Al content exceeds 7% by mass, the corrosion resistance deteriorates suddenly with the increase of the Al content. It can be considered that this is because Al—Ca-based intergranular crystallized materials increase with the increase of the Al content, and the corrosion resistance deteriorates with the increase of such intermetallic compounds low in corrosion resistance.

Figure 6:
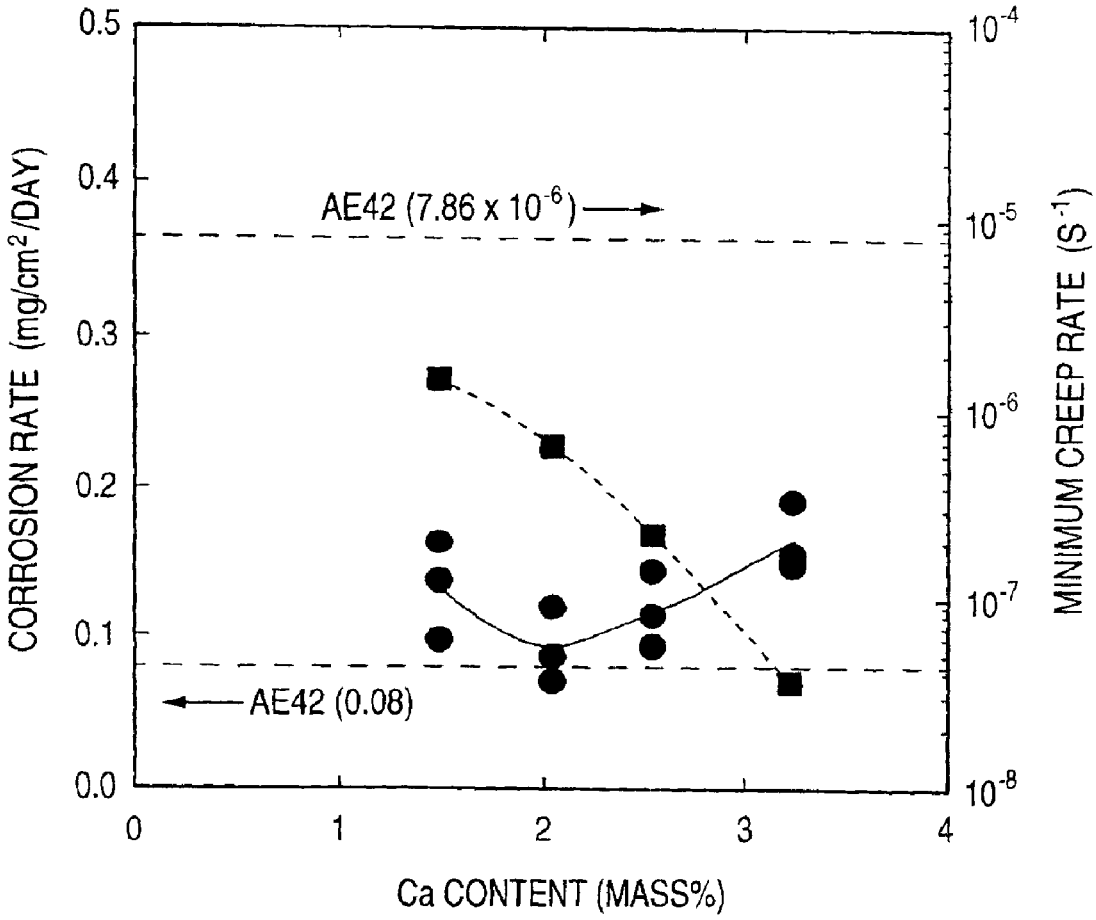
FIG. 6 is a graph showing the influence of the Ca content on the corrosion rate and the minimum creep rate.

Since Ca affected the corrosion resistance negatively, an attempt to reduce the Ca content was made in Mg alloys containing Al, Ca, Mm and Sr. FIG. 6 shows the influence of the Ca content on the corrosion rate and the minimum creep rate. The improvement of the corrosion resistance made by the reduction of the Ca content does not appear as conspicuously as that in alloys not containing Mm. It is understood that Mm has a great influence on the improvement of the corrosion resistance.

Figure 7:
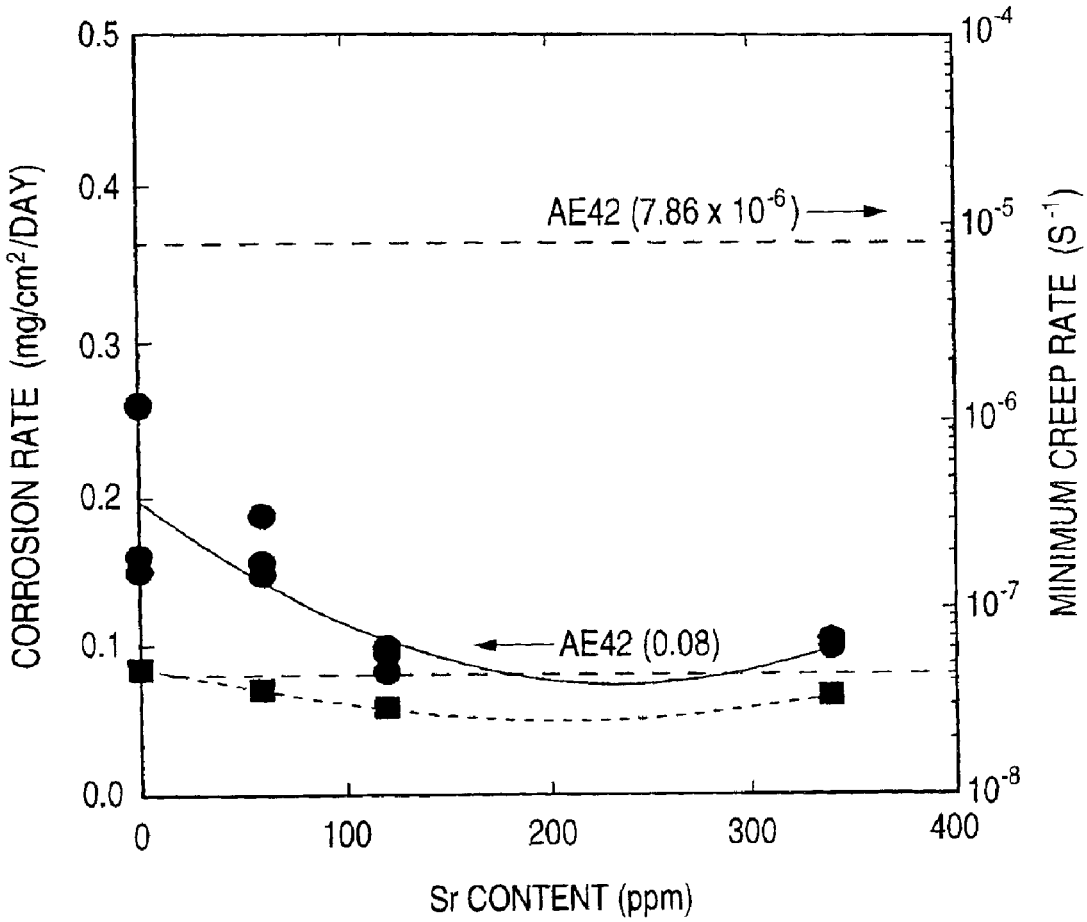
FIG. 7 is a graph showing the influence of the Sr content on the corrosion rate and the minimum creep rate.

FIG. 7 shows the influence of the Sr content on the corrosion rate and the minimum creep rate in Mg alloys containing Al, Ca, Mm and Sr. Both the corrosion resistance and the creep properties have a tendency to be improved with the Sr content not higher than 100 ppm, and then to be lowered with the increase of Sr. In addition, the aimed value of corrosion rate 0.1 $mg/cm^2$/day was attained when the Sr content was 100 ppm.

Figure 8:
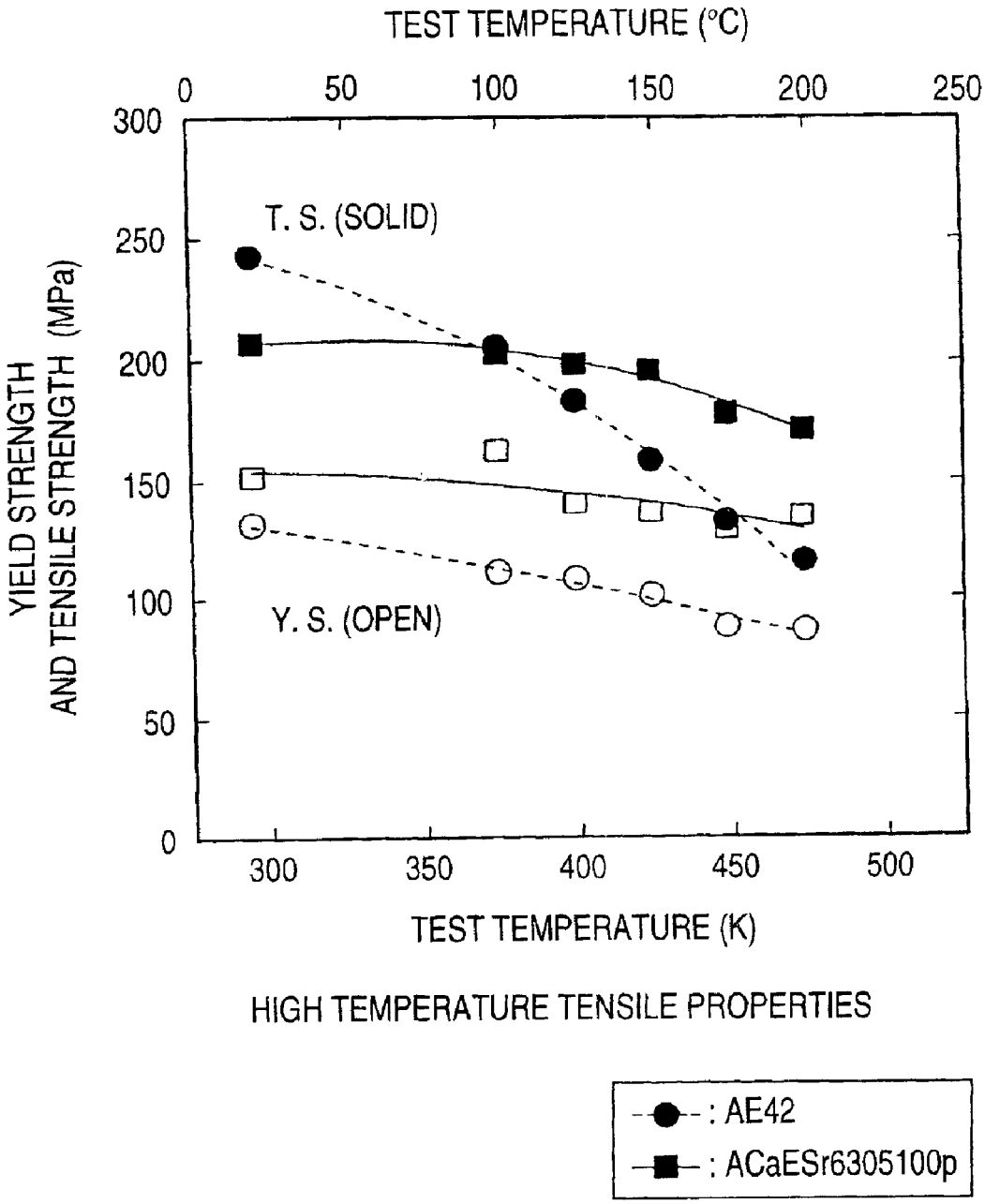
FIG. 8 is a graph showing the yield strength and the tensile strength of alloys of the invention obtained in tensile tests at elevated temperatures.

FIG. 8 shows the yield strength and the tensile strength calculated in tensile tests at elevated temperatures conducted on an alloy containing 6% by mass of Al, 3% by mass of Ca, 0.5% by mass of Mm, 0.01% by mass of Sr and 0.2% by mass of Mn according to the invention, which is the most excellent in the corrosion resistance and the creep properties. As for the yield strength, the alloy shows characteristic superior to AE42 at any temperatures. As for the tensile strength, AE42 is superior at room temperature, but deterioration of strength is rarely recognized up to 423K in the alloy according to the invention.

Figure 9:
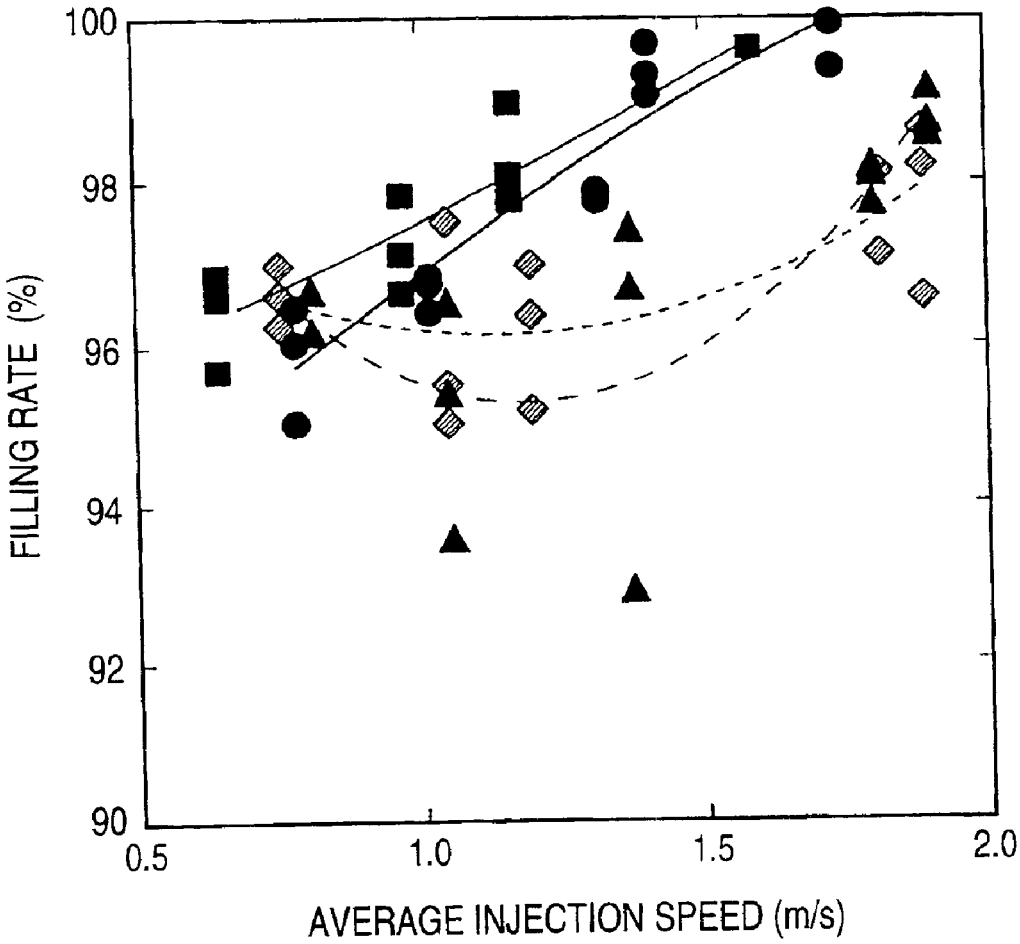
FIG. 9 is a graph showing the influence of Mm on the filling rate.
Figure 9:
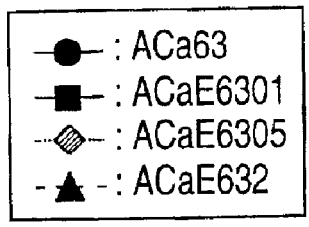

FIG. 9 shows the relationship between the average injection speed and the filling rate in Mm containing alloys not containing Sr. The alloy containing 0.1% by mass of Mm (ACaE6301) shows excellent formability. However, if the Mm content exceeds 0.5% by mass (ACaE6305), the formability deteriorates due to the increase of the Mm content.

Figure 10:
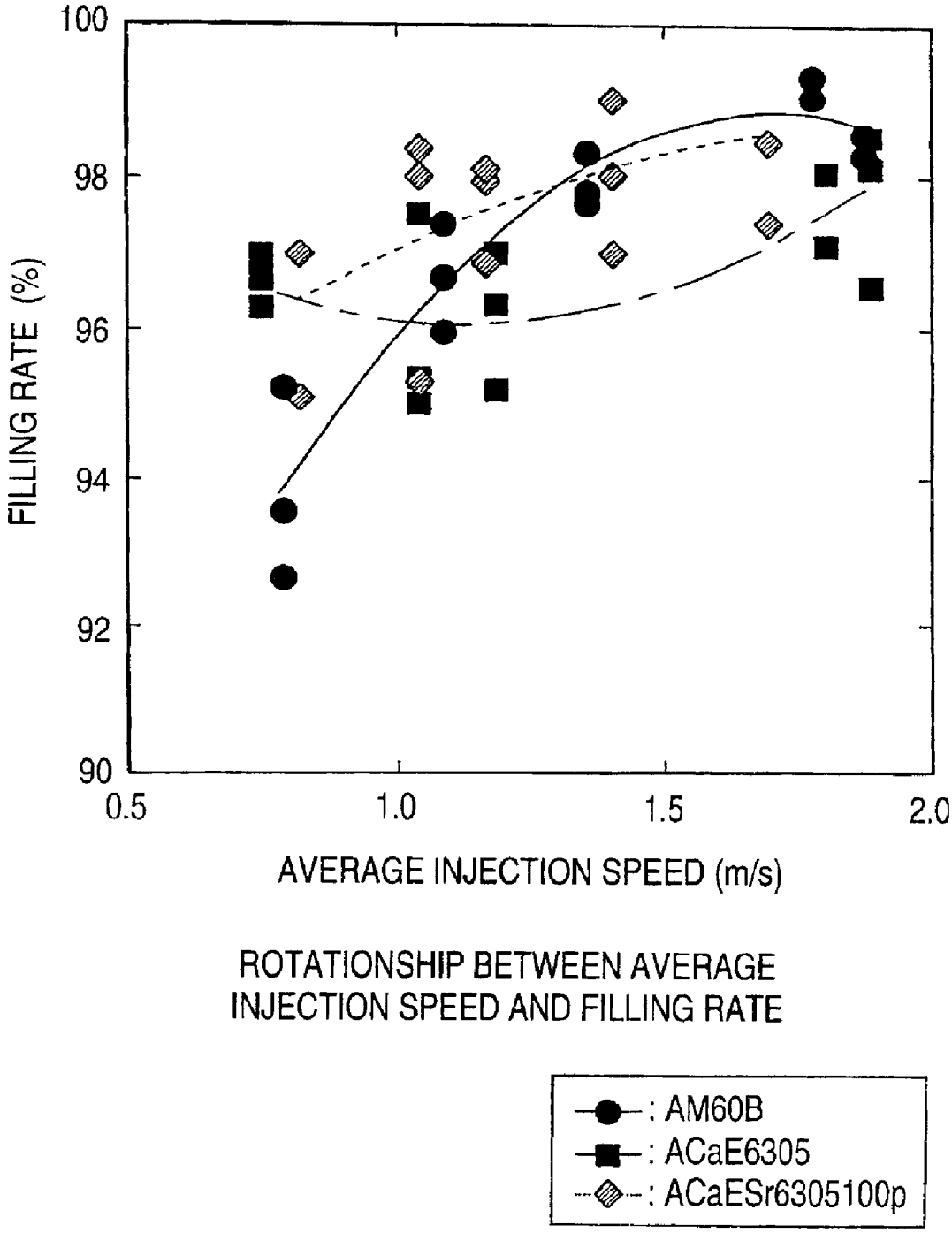
FIG. 10 is a graph showing the relationship between the average injection velocity and the filling rate in alloys of the invention.

FIG. 10 shows the relationship between the average injection speed and the filling rate in Sr containing alloys according to the invention. FIG. 10 also shows the result of AM60B which is an existing alloy for comparison. It was recognized that the deterioration of formability caused by the addition of Mm exceeding 0.5% by mass was improved by the addition of Sr (inventive alloy: ACaESr6305100p), and formability equal to that in AM60B could be obtained. Further, the test was also carried out on AE42 under similar conditions, but molding was difficult and estimation could not be therefore made.

Incidentally, data about the metal injection molding method was shown in Examples. However, if the solid phase ratio before injection is 50% or lower with which good formability can be secured, alloys according to the invention can be applied to any other high-pressure casting method such as die-casting or squeeze casting.

In addition, Mm was used as rare earth elements in Examples. Not to say, rare earth elements in the invention are not limited to the form of Mm.

As described above, according to the invention, there is provided a magnesium alloy containing mass percent Al: 5% to 7%, Ca: 2% to 4%, Mn: 0.1% to 0.8%, Sr: 0.001% to 0.05% and rare earth elements: 0.1% to 0.6%, and a remainder of the magnesium alloy being composed of Mg and unavoidable impurities. If necessary, an allowable content is set in each of Si, Zn, Cu, Ni, Fe and Cl of the unavoidable impurities, with Si not higher than mass percent 0.01%, Zn not higher than mass percent 0.01%, Cu not higher than mass percent 0.008%, Ni not higher than mass percent 0.001%, Fe not higher than mass percent 0.004%, and Cl not higher than mass percent 0.003%. Accordingly, the alloy can be applied to structures of transport instruments such as automobile parts needing corrosion resistance and heat resistance which were difficult in the conventional alloys. Thus, the weight of an automobile body can be reduced so that the improvement of fuel consumption can be expected to contribute to suppression of global warming. In addition, alloys and alloy members according to the invention can be used also in other fields such as household appliances needing heat resistance.

What is claimed is:

1. A magnesium alloy superior in corrosion resistance and heat resistance, containing mass percent Al: 5% to 7%, Ca: 2% to 4%, Mn: 0.1% to 0.8%, Sr: 0.001% to 0.0072% and rare earth elements: 0.1% to 0.6 and a remainder of said magnesium alloy being composed of Mg and unavoidable impurities, wherein said alloy molten is produced by a high pressure casting process of injecting the alloy under a semi solid condition being 50% or less in solid phase rate into a die.

2. A magnesium alloy superior in corrosion resistance and heat resistance according to claim 1, wherein an allowable content is set in each of Si, Zn, Cu, Ni, Fe and Cl of said unavoidable impurities, with Si not higher than mass percent 0.01%, Zn not higher than mass percent 0.01%, Cu not higher than mass percent 0.008%, Ni not higher than mass percent 0.001%, Fe not higher than mass percent 0.004%, and Cl not higher than mass percent 0.003%.

* * * * *